United States Patent [19]

Griffin

[11] 4,429,352

[45] Jan. 31, 1984

[54] FLASHLIGHT

[76] Inventor: James P. Griffin, 1216 Ash St., St. Charles, Ill. 60174

[21] Appl. No.: 479,853

[22] Filed: Mar. 28, 1983

[51] Int. Cl.[3] ..... F21L 7/00

[52] U.S. Cl. ..... 362/189; 362/186; 362/204; 362/205

[58] Field of Search ..... 362/189, 186, 204, 205

[56] References Cited

U.S. PATENT DOCUMENTS

| | | | |
|---|---|---|---|
| 4,122,510 | 10/1978 | Halliday | 362/189 |
| 4,210,953 | 7/1980 | Stone | 362/189 |
| 4,242,724 | 12/1980 | Stone | 362/189 |

*Primary Examiner*—Stephen J. Lechert, Jr.
*Attorney, Agent, or Firm*—John L. Schmitt

[57] ABSTRACT

A compact, disposable-type flashlight which is particularly suited to be carried on one's person, in a briefcase or purse, has a hollow, oval shaped case. Caps cover ends of the case with a bulb carried in one cap. The bulb extends into the case where a base of the bulb engages an end wall of a resilient member. The resilient member in turn separates a pair of batteries which have an insulated and uninsulated outer casing respectively. A conductive strap fits about the casings to join the batteries to the resilient member. The batteries are opposingly positioned allowing a conductive plate in the other cap to connect opposite terminals of the batteries in series. A pair of lead wires extend from the bulb base with one wire connected to the positive terminal of the insulated battery while the other lead wire is free and extends into a space between the case and the strap. To activate the flashlight the case is manually squeezed to force the free lead wire to contact the strap. This contact completes an electrical circuit between the batteries and the bulb to energize the bulb.

7 Claims, 4 Drawing Figures

KNIGHT

FLASHLIGHT

BACKGROUND OF THE INVENTION

1. Field of the Invention

This invention relates to portable sources of light and more particularly to disposable-type flashlights which are typically discarded when the batteries of such are exhausted.

2. Prior Art

A convenient source of portable electric light was made possible by the development of small, dry-cell batteries. Such light sources are now commonly called flashlights and are available in many sizes and shapes for general and specialized use. Most flashlights allow a user to replace the critical elements, i.e. batteries and bulb, when worn out. Other flashlights, because of their minimum expense, are made to be disposable when these elements become exhausted.

One such disposable-type flashlight is disclosed in U.S. Pat. No. 3,796,869. This flashlight has a flexible case which when manually compressed connects an end of a switch wire to an uninsulated casing wall of a battery to close an electrical circuit. A further disposable-type flashlight is disclosed in U.S. Pat. No. 4,122,510. This second flashlight has a battery retainer to hold a pair of batteries. A positive terminal of one battery fits into an aperture in one leg portion of a switch member. Another leg portion of the switch member is positioned to be pressed against and contact an uninsulated outer casing of the other battery. This contact completes an electrical circuit between the batteries and a bulb to energize the bulb.

SUMMARY OF THE INVENTION

A disposable-type flashlight, particularly suitable for personal use, includes a flexible case having cap covered ends. A bulb is carried by one cap with its lens portion extending outwardly therefrom. A base of the bulb extends into the case to compressively engage an end of an elongated resilient member. A pair of batteries, opposingly positioned, are spaced apart by the resilient member. One battery has an insulated outer casing while the other is uninsulated. A conductive strap fits about the battery casings to press the batteries against the resilient member. A conductive plate in the other cap connects the batteries in series.

A pair of lead wires extend from the bulb base with one lead wire connecting with the positive terminal of the insulated battery. The other lead wire is free and extends into the case in a space between the case and the strap. When the case is selectively compressed, the free lead wire is forced into contact with the strap. This contact closes an electrical circuit between the bulb and batteries to energize the bulb.

The flashlight of this invention has several advantages over other known disposable-type flashlights.

A first advantage of this inventive flashlight is that it does not require a separate switch wire and related structure to locate the switch wire. One lead wire, a standard part of the bulb, serves as the switch to open and close the electrical circuit between the bulb and the batteries.

A second significant advantage is provided by the resilient member. Note that the strap presses the batteries into the resilient member to produce transverse stresses therebetween. These stresses promote electrical continuity between the strap and the uninsulated battery casing. Note further that the bulb engages the resilient member to press the batteries against the conductive plate in the end cap and produces longitudinal stresses between both end caps, the bulb, the batteries and the plate. These further stresses not only promote electrically continuity between the plate and the batteries but also fix the location of the above noted components within the case. This second noted result is particularly important because the free bulb lead wire must be kept from inadvertently contacting the strap.

Lastly, the resilient characteristic of this member allows the batteries and bulb to self-seat in the member. Thus, the member may have a simple box-like configuration without the need for intricate preformed structure to hold the batteries and the bulb. The above noted advantages eliminate and simplify structure heretofore used in such flashlights to provide a significant cost reduction. Since the flashlight is disposable, minimizing its cost of manufacture is critical.

DESCRIPTION OF THE PREFERRED EMBODIMENT

Figures 1, 2, 3, 4:
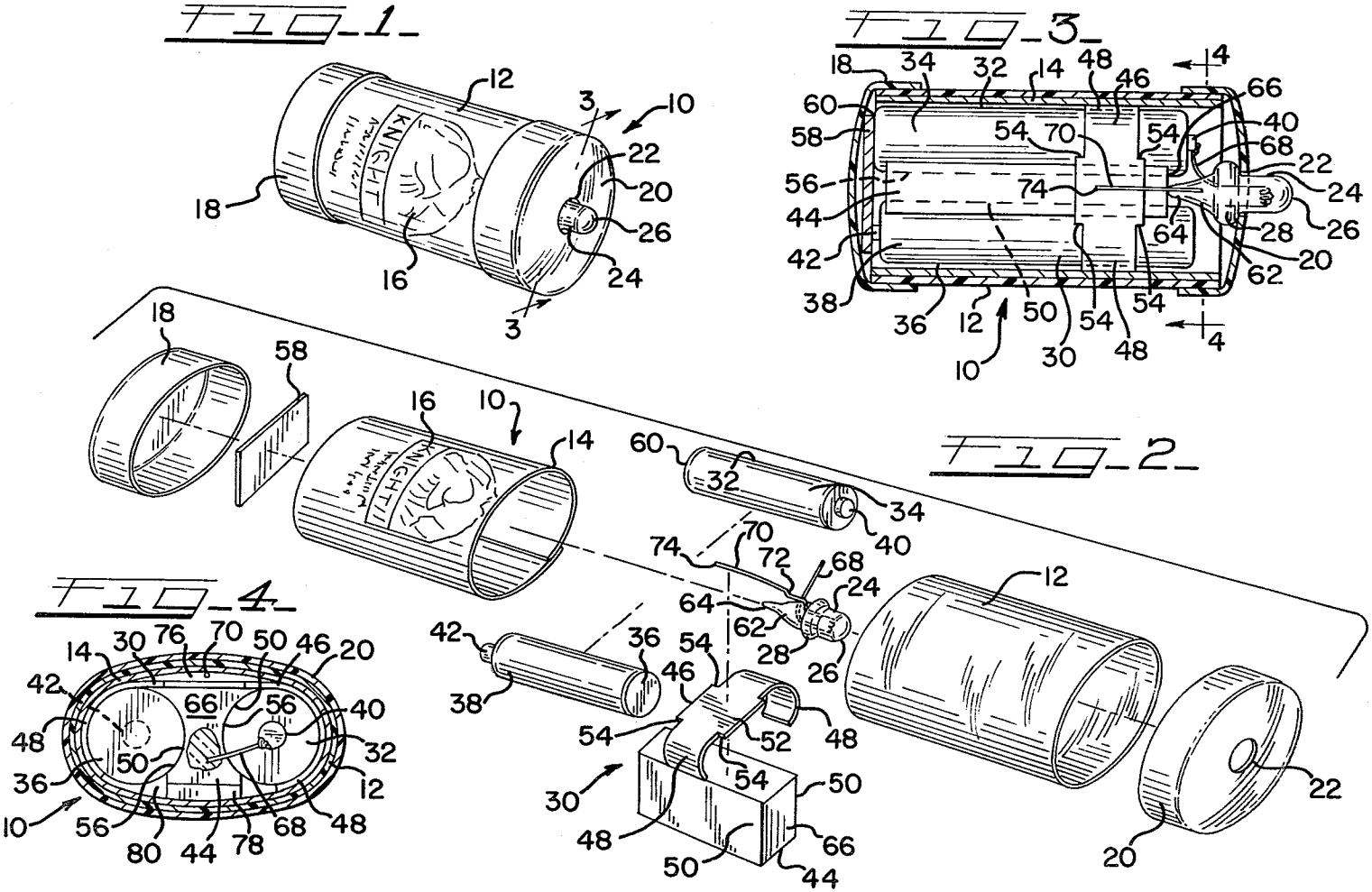
FIG. 1 is a perspective view of the flashlight of this invention.
FIG. 2 is an exploded view in perspective of the flashlight of FIG. 1 showing the relationship of its various components.
FIG. 3 is a cross-sectional view as seen generally along the line 3—3 of FIG. 1.
FIG. 4 is a cross-sectional view as seen generally along the line 4—4 of FIG. 3.

A flashlight of this invention is shown generally in FIG. 1 and designated 10. The flashlight 10 includes a case 12 which may be made of a flexible, clear plastic material, for example. The case 12 has an oval-like cross-sectional configuration and may contain a paper liner 14 printed with advertising or like indicia 16 promoting the name of a firm or product.

One end of the case 12 is covered by an end cap 18. An opposite end is covered by a like end cap 20 having an aperture 22 to hold a bulb 24. A lens portion 26 of the bulb 24 extends outward from the cap 20 while an enlarged portion 28 of the bulb 24 abuts an inside of the end cap 20. The end caps 18, 20 are sized to fit closely about the case 12 and may be joined to such by an adhesive, for example.

Within the case 12 is a battery assembly 30 comprising a first battery 32 having an insulated outer casing 34 and a second battery 36 having an uninsulated outer casing 38. The batteries 32,36 are positioned in an opposing manner such that a positive terminal 40 of the insulated battery 32 faces the cap 20 while a positive terminal 42 of the uninsulated battery 36 faces the cap 18. The batteries 32,36, AAA in size with each having a 1.5 volt output, are spaced apart by a resilient member 44. A conductive strap 46 having end portions 48 in part encircle the battery casings 34,38 to hold the batteries 32,36 firmly against sidewalls 50 of the resilient member 44. The end portions 48 of the strap 46 project outwardly from a middle portion 52 to form sets of offsets 54. These offsets 54 aid in locating the strap 46 during production of the assembly 30.

The preferred material from which to make the resilient member 44 is styrofoam. This material allows the batteries 32,34 to form self-seating grooves 56, see FIG.

4, within the sidewalls 50 while at the same time is sufficiently resilient to produce transverse stresses within the assembly 30. These stresses promote continuous electrical continuity between the uninsulated battery casing 38 and the conductive strap 46 during the life of the flashlight 10.

Within the end cap 18 is a conductive plate 58 which engages the positive terminal 42 of the battery 36 and an end wall 60, i.e., negative terminal, of the battery 32. The plate 58 thus connects the batteries 32, 36 in series to provide a total 3 volt output.

As best seen in FIGS. 2, 3 the bulb 24 further includes a conical shaped base 62. A tip 64 of the bulb base 62 engages an end wall 66 of the resilient member 44 and self-seats therein. The case 12 is so dimensioned that the bulb base 64 presses firmly against the resilient member end wall 66 to produce longitudinal stresses between the caps 18,20, the bulb enlarged portion 28, the bulb base 62, the resilient member 44, the battery terminals 42,60 and the conductive plate 58. These longitudinal stresses promote continuous electrical continuity between the terminals 42,60 and the plate 58 as well as help keep the bulb 24 properly located within the cap aperture 22.

Extending outwardly from the bulb base 62 is a first and a second lead wire 68,70. The first lead wire 68 is soldered to the positive battery terminal 40. The second lead wire 70 is free and formed with a series of offsets 72, see FIG. 2. An outer end 74 of the free lead wire 70 projects into a space 76 formed between the case 12 and the strap middle portion 52; see FIG. 4. The offsets 72 position the lead wire outer end 74 next to the case 12 to help prevent inadvertent contact between the lead wire outer end 74 and the strap 46.

The compact configuration of the flashlight 10 allows a user to conveniently carry the flashlight 10 in a pocket, briefcase, or purse. When the user wishes to have a light source, the flashlight 10 typically is hand held and the case 12 manually compressed. Compression of the flexible case 12 proximate the location of the free lead wire 70 forces the lead wire end 74 against the strap 46. This contact between the lead wire outer end 74 and the strap 46 closes an electrical circuit between the bulb 24 and the batteries 32, 36. To provide additional firmness to the case 12, a further piece of resilient material 78, i.e. styrofoam, may be placed in a space 80 in the case 12, opposed the space 76. When the batteries 32,36 are exhausted, the flashlight 10 may be discarded.

While an embodiment of this present invention has been shown and described, it should be understood that the invention is not limited thereto except by scope of the claims. Various modifications and changes can be made without departing from the scope and spirit of the invention as the same will be understood by those skilled in the art.

What I claim is:

1. A disposable light source comprising:

a first and a second battery means to provide a source of electrical power, a resilient member positioned between said first and second battery means, a conductive strap positioned about said battery means and said resilient member to press said battery means against said resilient member and create stresses therebetween sufficient to insure electrical continuity between said strap and an uninsulated outer casing of said second battery means with insulation means positioned between said strap and said first battery means, a conductive plate means joining a negative terminal of said first battery means to a positive terminal of said second battery means to connect said first and second battery means in series, and a bulb means to provide a source of light, said bulb means having a first lead wire connected to a positive terminal of said first battery means and a second free lead wire located proximate said strap for selective engagement therewith, wherein engagement of said bulb free lead wire with said strap connects said first and second battery means to said bulb means to energize said bulb means and produce light.

2. A disposable-type flashlight comprising:

a flexible case, a first and second battery disposed in said case with said first battery having an insulated outer casing and said second battery having an uninsulated outer casing, an elongated resilient member positioned between said batteries, a conductive strap positioned about said batteries to maintain said batteries, said resilient member and said strap in a stressed relationship sufficient to insure electrical conduction between said strap and said second battery outer casing with said strap engaging with said first battery in a nonconductive manner, a conductive plate disposed in a cap covering one end of said case with said plate compressively engaging a negative terminal of said first battery and a positive terminal of said second battery, said engagement producing stresses sufficient to insure electrical conduction between said plate and said terminals, and a bulb carried in an aperture in a further cap covering an opposite end of said case, said bulb having a first lead wire connected to a positive terminal of said first battery and a second lead wire extending into said case in a space between said case and said strap, wherein said bulb may be energized by compression of said case adjacent said bulb second lead wire to engage said second lead wire with said strap.

3. A compact, disposable-type flashlight comprising:

a hollow, flexible case, a first and a second cap positioned respectively over ends of said case, a battery unit disposed in said case between said caps and including a pair of batteries having an insulated and uninsulated outer casing respectively and positioned side-by-side and in an opposing manner, said batteries spaced apart by a resilient member and held compressively thereagainst by a conductive strap engaged with said battery outer casings, said compression producing continuing transverse stresses sufficient to insure electrical continuity between said strap and said battery uninsulated outer casing, a metal plate in said first cap to engage an end wall of said insulated battery and a positive terminal of said uninsulated battery, a bulb carried in an aperture in said second cap with an enlarged portion of said bulb positioned inside of said cap and a base connecting with said enlarged portion with said base extending into said case to compressively engage an end wall of said resilient member, said engagement producing continuing longitudinal stresses sufficient to insure electrical continuity between said plate and said batteries and positioning of said bulb enlarged portion against said cap, and a first and a second lead wire carried by said bulb, said first lead wire connecting with a positive terminal of said insulated battery and said second lead wire extending into said case to a space defined in part by said case and a middle portion said strap, wherein said case may be manually compressed to force said second free lead wire of said bulb to engage said strap to close an electrical circuit and energizes said bulb and with said circuit being de-energized by a discontinuance of compression of said case allowing said bulb free lead wire to disengage from said strap.

4. A flashlight as defined by claim 3 and further characterized by, said first and said second caps having substantially similar configurations.

5. A flashlight as defined by claim 3 and further characterized by, a resilient piece carried in said case on a side opposite said bulb second lead wire.

6. A flashlight as defined by claim 3 and further characterized by, said second lead wire formed with an offset to position an outer end of said lead wire closer to said case than to said strap.

7. A flashlight as defined by claim 3 and further characterized by, said strap having end portions joining a middle portion with offsets formed therebetween.

* * * * *